US008366069B2

(12) United States Patent
Rodecker

(10) Patent No.: US 8,366,069 B2
(45) Date of Patent: Feb. 5, 2013

(54) ISOLATOR HAVING SOCKET MOUNTING

(75) Inventor: Troy P. Rodecker, Berlin Heights, OH (US)

(73) Assignee: The Pullman Company, Milan, OH (US)

( * ) Notice: Subject to any disclaimer, the term of this patent is extended or adjusted under 35 U.S.C. 154(b) by 87 days.

(21) Appl. No.: 13/008,998

(22) Filed: Jan. 19, 2011

(65) Prior Publication Data

US 2012/0181412 A1 Jul. 19, 2012

(51) Int. Cl.
*E21F 17/02* (2006.01)

(52) U.S. Cl. ..... 248/634; 248/62; 267/141.4; 180/296; 180/89.2

(58) Field of Classification Search ..... 248/634, 248/58, 62; 180/296, 309, 89.2; 267/141.4
See application file for complete search history.

(56) References Cited

U.S. PATENT DOCUMENTS

| | | | | | |
|---|---|---|---|---|---|
| 2,156,639 | A | * | 5/1939 | Powell | 52/709 |
| 2,944,778 | A | * | 7/1960 | Katis | 248/62 |
| 3,261,579 | A | * | 7/1966 | Engman et al. | 248/60 |
| 3,261,580 | A | * | 7/1966 | Schauster | 248/62 |
| 3,807,675 | A | * | 4/1974 | Seckerson et al. | 248/73 |
| 3,809,799 | A | * | 5/1974 | Taylor | 174/68.3 |
| 4,516,296 | A | * | 5/1985 | Sherman | 24/279 |
| 4,524,937 | A | * | 6/1985 | Zizan | 248/74.3 |
| 4,950,099 | A | * | 8/1990 | Roellin | 403/348 |
| 5,222,701 | A | * | 6/1993 | Rowland | 248/74.3 |
| 5,673,877 | A | * | 10/1997 | Karner et al. | 248/58 |
| 5,967,468 | A | * | 10/1999 | Veghte et al. | 248/71 |
| 6,058,562 | A | | 5/2000 | Satou et al. | |
| 6,070,849 | A | | 6/2000 | Larmande et al. | |
| 6,095,460 | A | | 8/2000 | Mercer et al. | |
| D448,657 | S | * | 10/2001 | Calvert | D8/396 |
| 6,536,717 | B2 | * | 3/2003 | Parker | 248/49 |
| 6,572,070 | B2 | | 6/2003 | Arciero et al. | |
| 6,739,557 | B2 | | 5/2004 | Kato | |
| 6,758,300 | B2 | | 7/2004 | Kromis et al. | |
| 6,854,561 | B2 | | 2/2005 | Bass | |
| 7,165,645 | B2 | | 1/2007 | Chae | |
| 7,510,043 | B2 | | 3/2009 | Cerri, III | |
| 7,644,911 | B2 | * | 1/2010 | Rodecker | 267/293 |
| 2005/0242253 | A1 | * | 11/2005 | McClure et al. | 248/230.5 |

FOREIGN PATENT DOCUMENTS

| | | | |
|---|---|---|---|
| JP | 08-170527 | A | 7/1996 |
| JP | 2005-325802 | A | 11/2005 |
| WO | 2009-111117 | A1 | 9/2009 |

OTHER PUBLICATIONS

Search Report and Written Opinion dated Apr. 30, 2012 in corresponding PCT Application No. PCT/US2011/065103.

* cited by examiner

*Primary Examiner* — Terrell McKinnon
*Assistant Examiner* — Daniel J Breslin
(74) *Attorney, Agent, or Firm* — Harness, Dickey & Pierce, P.L.C.

(57) ABSTRACT

An isolator assembly includes an elastomeric assembly which is disposed within a socket defined by a supporting structure. The socket defines a transition portion, a retention rib and a stopping rib. The elastomeric assembly is positioned in the socket by sliding the elastomeric assembly through the transition portion so that the elastomeric assembly is compressed as it moves into the retention rib. The stopping rib engages an end surface of the elastomeric assembly once it has been properly positioned in the socket.

17 Claims, 4 Drawing Sheets

ISOLATOR HAVING SOCKET MOUNTING

FIELD

The present disclosure relates to a mounting arrangement for an exhaust system of a vehicle. More particularly, the present disclosure relates to an exhaust isolator which is mounted directly to a vehicle's frame or underbody, thus eliminating the need for brackets, bolts, welded frame nuts, clipped in frame nuts or the like.

BACKGROUND

The statements in this section merely provide background information related to the present disclosure and may not constitute prior art.

Typically, automotive vehicles, including cars and trucks, have an internal combustion engine which is coupled to at least a transmission and a differential for providing power to the driven wheels of the vehicle. An engine exhaust system which typically includes an exhaust pipe, a catalytic converter, a muffler and a tail pipe is attached to the engine to quiet the combustion process, to clean the exhaust gases and to route the products of combustion away from the engine. The exhaust system is supported by exhaust mounts or isolators which are positioned between the exhaust system and the frame, the underbody or some other supporting structure of the vehicle's body. In order to prevent engine movement and/or vibrations from being transmitted to the vehicle's body, the exhaust mounts or isolators incorporate flexible mounting members or elastic suspension members to isolate the vehicle's body from the exhaust system.

Typical prior art exhaust mounts or isolators include an upper hanger which is attached to the vehicle's frame or other support structure of the vehicles' body. The upper hanger extends from the support structure such that it positions an elastomeric isolator at the proper location to accept a lower hanger which extends from the elastomeric isolator to one of the exhaust system's components. The elastomeric isolator is secured in a specific location between the upper hanger and the lower hanger. Typically, the upper hanger includes assembly hardware such as stamped brackets, bolts, welded frame nuts, clip-in frame nuts and/or formed rods which are utilized to secure the upper mount to the frame or other supporting structure and to secure the elastomeric isolator to the upper mount. This hardware increases the costs and the amount of labor necessary for the construction and assembly of the vehicle.

SUMMARY

The present disclosure describes an engine mount or isolator which is mounted directly to the vehicle's frame or other supporting structure of the vehicle's body. The direct attachment of the exhaust mount or isolator eliminates the need for the upper hanger and all of the associated hardware. The exhaust mount or isolator can be fit directly within a socket formed in the support structure. The elastomeric portion of the exhaust mount or isolator includes a hole which accepts a support rod or lower hanger which is attached to the component of the exhaust system. The support rod or lower hanger can be formed to position the component of the exhaust system in the desired location. The socket is formed in the supporting structure and the exhaust mount or isolator is designed to be inserted and retained within the socket.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
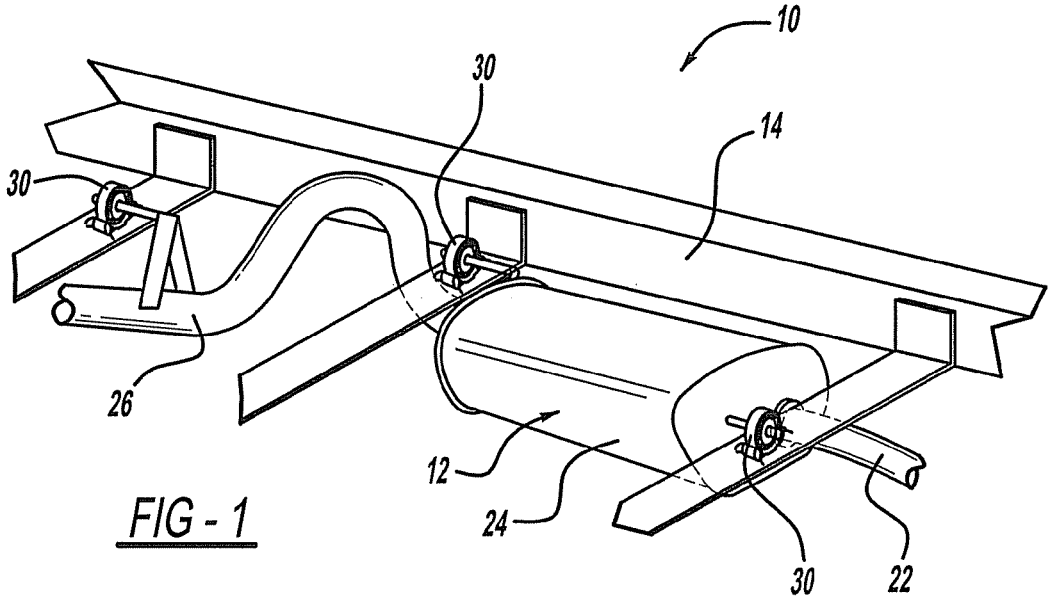
FIG. 1 is a perspective view of an exhaust system attached to a support structure of a vehicle with exhaust isolators in accordance with the present disclosure.
Figure 2:
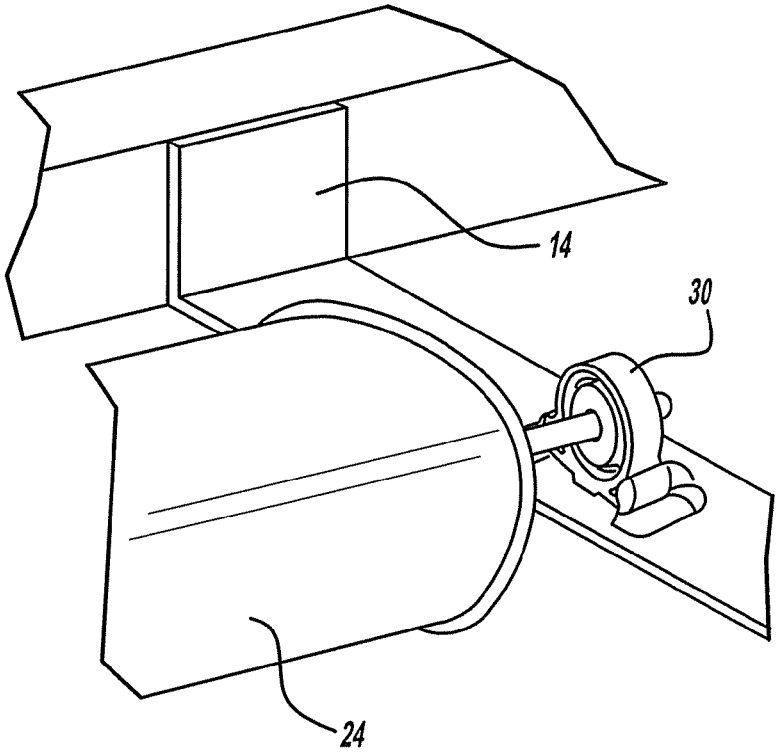
FIG. 2 is an enlarged perspective view of one of the exhaust isolators illustrated in FIG. 1.

The following description is merely exemplary in nature and is not intended to limit the present disclosure, application, or uses. There is shown in FIG. 1, an exhaust mounting system in accordance with the present disclosure which is identified generally by the reference numeral 10. Exhaust mounting system 10 attaches an exhaust system 12 to a supporting structure 14 of a vehicle. The vehicle includes an internal combustion engine (not shown), an unsprung mass including wheels and a suspension system (not shown) and a sprung mass which includes a vehicle body (not shown) which is supported by supporting structure 14. Exhaust system 12 is connected to the engine of the vehicle and exhaust system 12 routes the products of combustion of the engine to the rear of the vehicle. The internal combustion engine powers the wheels of the vehicle through a transmission (not shown) and a differential (not shown).

Exhaust system 12 comprises an intermediate pipe 22, a muffler 24, a tailpipe 26 and a plurality of exhaust isolator assemblies 30. Intermediate pipe 22 is typically connected to a catalytic converter (not shown) which is connected to an exhaust pipe (not shown) which is in turn connected to an exhaust manifold (not shown) which is one of the components of the vehicle's internal combustion engine. The catalytic converter may be connected to a single exhaust pipe which leads to a single exhaust manifold or the catalytic converter can be attached to a branched exhaust pipe which leads to a plurality of exhaust manifolds. Also, intermediate pipe 22 can be connected to a plurality of catalytic converters which connect together prior to reaching muffler 24 using a branched intermediate pipe 22 or the vehicle can have a plurality of exhaust manifolds, connected to a plurality of exhaust pipes, connected to a plurality of catalytic converters, connected to a plurality of intermediate pipes, connected to a plurality of mufflers, connected to a plurality of exhaust pipes. The present disclosure is applicable to the above described exhaust systems as well as any other exhaust system known in the art.

Exhaust system 12 is utilized to route the exhaust gases from the vehicle's engine to the rear area of the vehicle. While the exhaust gas travels from the engine to the rear of the vehicle through exhaust system 12, the catalytic cleaner cleans the exhaust gases and muffler 24 quiets the noises associated with the combustion process of the vehicle's engine. Exhaust isolator assemblies 30 provide for the support of exhaust system 12 underneath the vehicle and they operate to prevent engine movement and other vibrations from being transmitted to the vehicle's body. In addition, exhaust isolator assemblies 30 provide proper positioning and alignment for exhaust system 12 during assembly of exhaust system 12 and during the operation of the vehicle.

Referring now to FIGS. 3-7, exhaust isolator assembly 30 comprises an elastomeric assembly 40 and a hanger pin 42. Elastomeric assembly 40 comprises an insert 44 which is molded into an elastomeric body 48.

Elastomeric assembly 40 is a single-hole shear hub design where elastomeric body 48 defines a hole 50 which is designed to accept hanger pin 42. Hanger pin 42 is secured to one of the components of exhaust system 12 and elastomeric assembly 40 is attached to the frame or supporting structure 14 of the vehicle. Thus, exhaust system 12 is secured to the vehicle through elastomeric assembly 40. Elastomeric assembly 40 also defines a pair of mounting ears 52 extending from an outer surface of elastomeric assembly 40.

Elastomeric body 48 defines an outer circumferential void 56 and an inner circumferential void 58. While voids 56 and 58 are illustrated as being asymmetrical with respect to hole 50, it is within the scope of the present disclosure to have voids 56 and 58 symmetrical to hole 50. The design of voids 56 and 58, specifically their wall thickness, will determine the amount of travel until the rate of elastomeric assembly spikes up due to the closing of voids 56 and 58. Until the closing of voids 56 and 58, the radial loads cause pure shear stress in elastomeric body 48 regardless of the loading direction.

Figure 7:
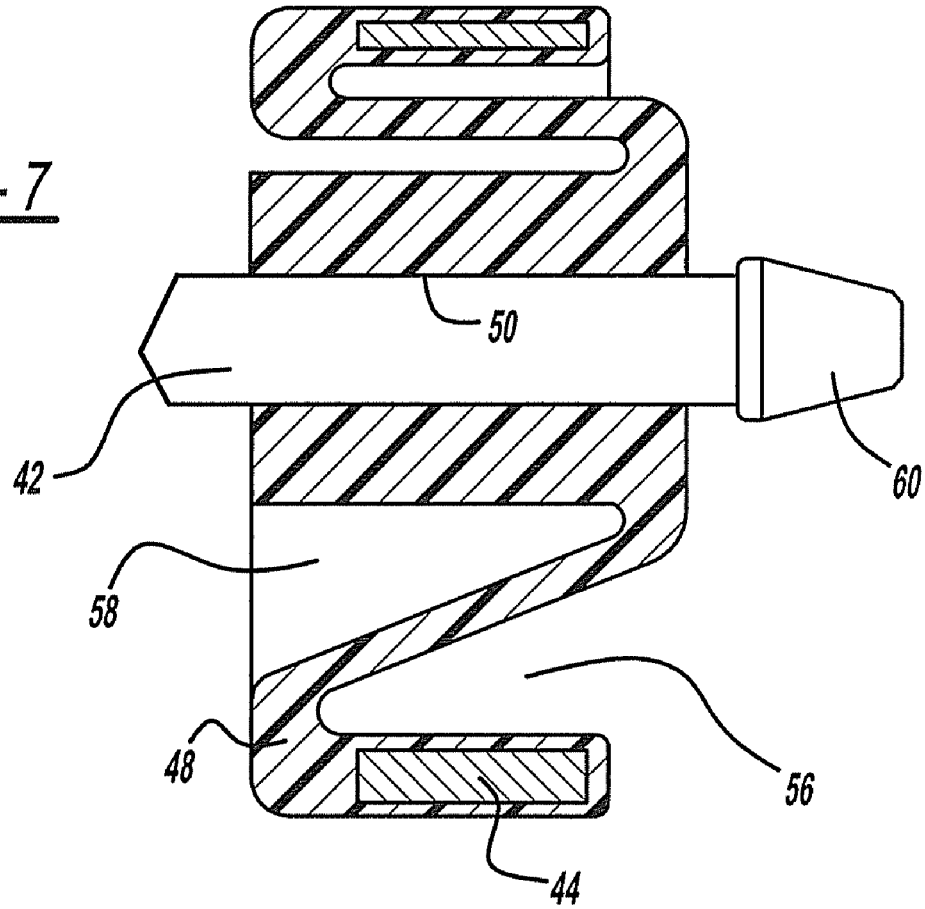
FIG. 7 is a cross-sectional view of the isolator illustrated in FIG. 6.

The loading direction for elastomeric assembly 40 can be in any radial direction around hole 50. Tuning for rate and deflection in selective directions can be accomplished independently from other directions by altering voids 56 and 58 in the appropriate circular sectors. As can be seen from FIG. 7, void 56 overlaps with void 58. The larger the overlap between voids 56 and 58, the lower the stresses and stiffness for elastomeric assembly 40. The peak loads bottom out voids 58 and 60 and start to impart compressive stresses to elastomeric body 48 from hanger pin 42 and insert 44. As illustrated in FIG. 7, insert 44 extends around the outer region of elastomeric body 48. The bottoming of voids 56 and 58 and the subsequent compression of elastomeric body 48 makes the compressive stresses spread out rather than having the compressive stresses concentrated in a spoke or leg cross-section as in the prior art. This permits the stress magnitude to decrease as well as changing the stress loading to a more favorable type.

Hanger pin 42 is inserted through hole 50 during the installation of exhaust system 12. Hanger pin 42 is a formed rod which can include compound bends such that a first end is positioned to axially engage hole 50 and a second, opposite end is designed to mate with and be secured to a component of exhaust system 12. As illustrated, a different hanger pin 42 is used for each exhaust isolator assembly 30 but it is within the scope of the present disclosure to utilize as many common hanger pins 42 as the design of the specific application allows. An annular barb 60 is formed on the insertion end of each hanger pin 42 to resist the removal of hanger pin 42 from hole 50.

Figure 3:
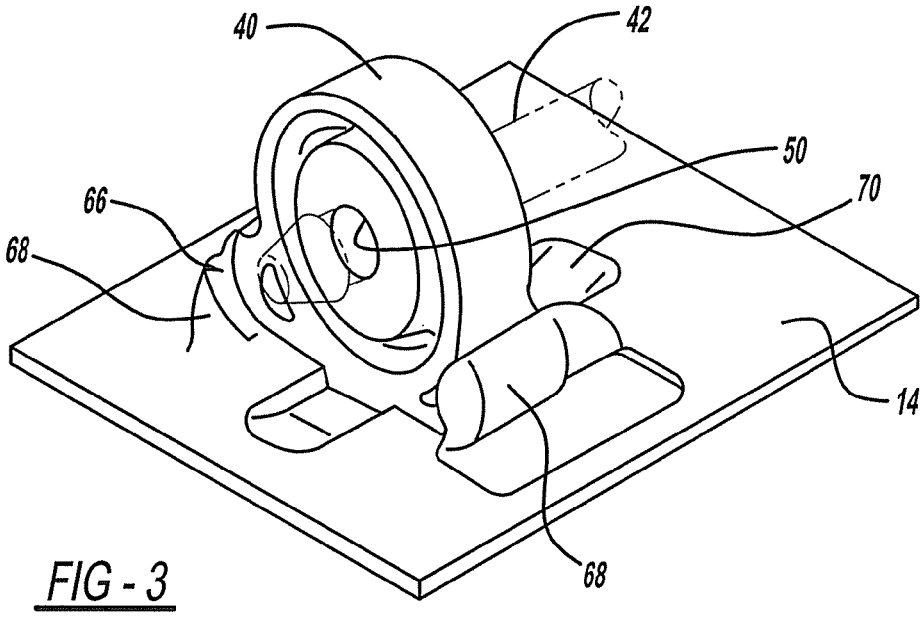
FIG. 3 is a perspective view of the exhaust isolator illustrated in FIGS. 1 and 2.
Figure 4:
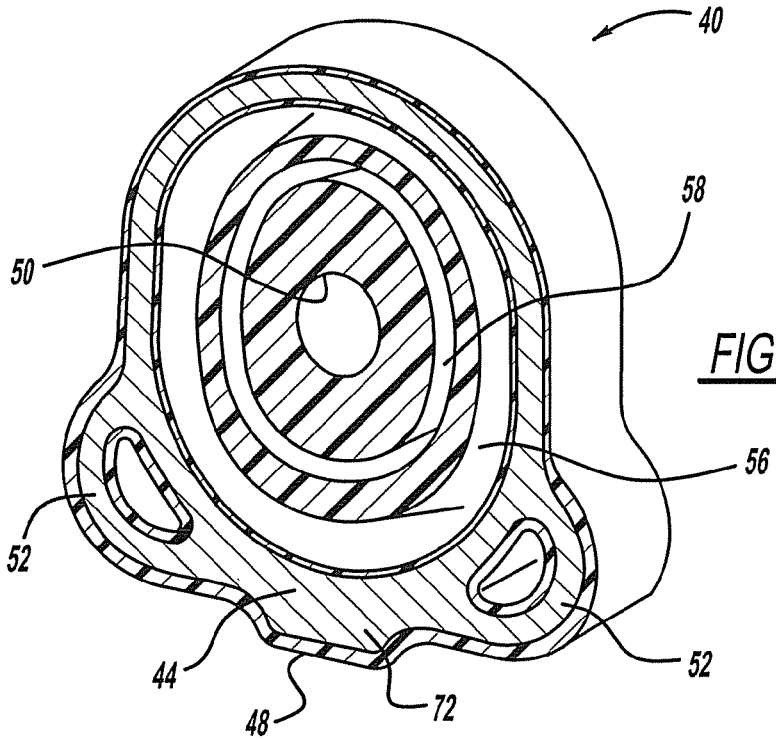
FIG. 4 is an end perspective view in cross-section of the exhaust isolator illustrated in FIGS. 1 and 2.
Figure 5:
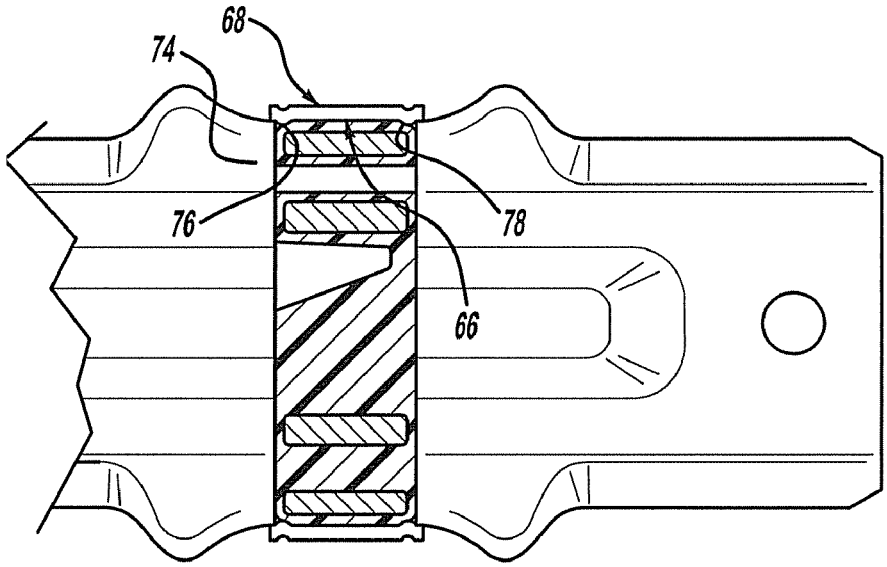
FIG. 5 is a plan view of the support structure illustrated in FIGS. 1 and 2.
Figure 6:
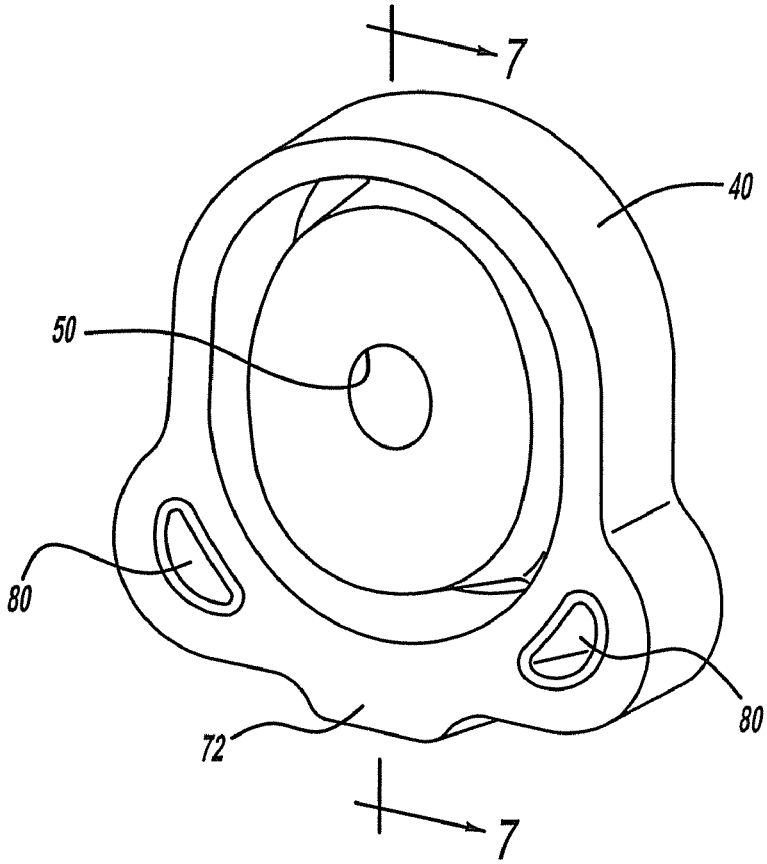
FIG. 6 is a perspective view of the isolator illustrated in FIGS. 1 and 2.

Elastomeric assembly 40 is designed to be assembled into a formed socket 66 defined by supporting structure 14. As illustrated in FIGS. 3-5, socket 66 comprises a pair of curved flanges 68 and a stiffening rib 70. Elastomeric assembly 40 defines a tab 72 which extends into stiffening rib 70.

Curved flanges 68 each include a transition portion 74, a retention rib 76 and a stopping rib 78. Transition portion 74 defines a funnel guiding elastomeric assembly 40 into socket 66 between curved flanges 68. Retention rib 76 is designed to extend the length of elastomeric assembly 40 and is sized such that elastomeric body 48 is compressed between the two retention ribs 76. The compression of elastomeric body 48 serves as means for retaining elastomeric assembly 40 within socket 66 after assembly of elastomeric assembly 40. Stopping rib 78 extends further inward than retention rib 76. Stopping rib 78 acts as a hard stop for an end surface of elastomeric assembly 40 when elastomeric assembly 40 is inserted into socket 66 and elastomeric assembly 40 is located in the proper position between curved flanges 68.

The assembly of elastomeric assembly 40 into socket 66 starts at transition portions 74 and ends at stopping ribs 78. Elastomeric assembly 40 is first inserted into transition portions 74 with each mounting ear 52 engaging a respective transition portion 74 and tab 72 engaging stiffening rib 70. Elastomeric assembly 40 is pushed through transition portions 74 and is pushed towards the pair of stopping ribs 78. When elastomeric assembly 40 engages stopping ribs 78, elastomeric assembly 40 is at its installed position. At this installed position, mounting ears 52 are located between the two retention ribs 76 and a specified amount of compression of elastomeric body 48 during the movement from transition portions 74 to stopping ribs 78 acts as means for retaining elastomeric assembly 40 within socket 66. The transition portion 74 acts as a funnel to simplify the insertion of elastomeric assembly 40 into socket 66 and the compression of elastomeric body 48.

As illustrated in FIG. 4, insert 44 is manufactured from plastic or steel and insert 44 extends around the outer region or periphery of elastomeric body 48, around the outer region or outer periphery of mounting ears 52 and into tab 72 to provide stiffness for elastomeric assembly 40. Each mounting ear 52 defines an aperture 80 which can assist in the assembly of elastomeric assembly 40 into socket 66 by providing accessibility for assembly machine alignment and assembly press tooling.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An isolator assembly in combination with a supporting structure for a vehicle body of a vehicle and an exhaust system of the vehicle, the combination comprising:

an elastomeric assembly disposed between said exhaust system and said supporting structure;

a socket defined by said supporting structure, said socket defining a first and a second flange, each flange defining an inner surface, the inner surface of said first flange directly facing the inner surface of said second flange, said elastomeric assembly being disposed between said inner surfaces of said first and second flanges;

wherein said elastomeric assembly defines a first and a second mounting ear directly engaging each of said inner surface of said first and second flanges to secure said elastomeric assembly to said supporting structure; and wherein said first flange defines a first transition portion extending toward a first retention rib and a first stopping rib spaced from the first retention rib, said first retention rib and said first stopping rib extending from said first flange toward said second flange, said elastomeric assembly directly engaging said retention rib.

2. The isolator assembly according to claim 1, wherein said first transition portion defines a funnel leading to said first retention rib.

3. The isolator assembly according to claim 1, wherein an end surface of said elastomeric assembly directly engages said first stopping rib.

4. The isolator assembly according to claim 1, wherein said supporting structure defines a stiffening rib, said elastomeric assembly defining a tab disposed within said stiffening rib.

5. The isolator assembly according to claim 1, wherein said second flange defines a second transition portion extending toward a second retention rib and a second stopping rib spaced from said second retention rib, said second retention rib and said second retention rib extending from said second flange toward said first flange, said elastomeric assembly directly engaging said first and second retention ribs.

6. The isolator assembly according to claim 5, wherein said elastomeric assembly comprises an elastomeric body, said elastomeric body directly engaging said first and second retention ribs.

7. The isolator assembly according to claim 6, wherein said elastomeric body is compressed a specified amount when said elastomeric body is disposed between said first and second retention ribs.

8. The isolator assembly according to claim 5, wherein said first and second transition portions define a funnel leading to said first and second retention rib.

9. The isolator assembly according to claim 8, wherein said elastomeric assembly comprises an elastomeric body, said elastomeric body directly engaging said first and second retention ribs.

10. The isolator assembly according to claim 9, wherein said elastomeric body is compressed a specified amount when said elastomeric body is disposed between said first and second retention ribs.

11. The isolator assembly according to claim 5, wherein an end surface of said elastomeric assembly directly engages said first and second stopping ribs.

12. The isolator assembly according to claim 11, wherein said elastomeric assembly comprises an elastomeric body, said elastomeric body directly engaging said first and second retention ribs.

13. The isolator assembly according to claim 12, wherein said elastomeric body is compressed a specified amount when said elastomeric body is disposed between said first and second retention ribs.

14. The isolator assembly according to claim 1, wherein said supporting structure defines a stiffening rib, said elastomeric assembly defining a tab disposed within said stiffening rib.

15. The isolator assembly according to claim 1 further comprising a hanger pin disposed within a hole defined by said elastomeric assembly, said hanger pin being attached to said exhaust system.

16. The isolator assembly according to claim 1 wherein each of said inner surfaces of said first and second flanges is a curved surface.

17. The isolator assembly according to claim 1 wherein said first mounting ear is sandwiched between said first flange and a surface of said supporting structure and said second mounting ear is sandwiched between said second flange and the surface of said supporting structure.

* * * * *